US005582553A

United States Patent [19]

Ashcraft et al.

[11] Patent Number: 5,582,553

[45] Date of Patent: Dec. 10, 1996

[54] GOLF CLUB HEAD WITH INTERLOCKING SOLE PLATE

[75] Inventors: Danny C. Ashcraft, Vista; Richard De La Cruz, Pauma Valley; Richard E. Parente, San Diego, all of Calif.

[73] Assignee: Goldwin Golf U.S.A., Inc., Carlsbad, Calif.

[21] Appl. No.: 270,909

[22] Filed: Jul. 5, 1994

[51] Int. Cl.[6] ..... A63B 53/04

[52] U.S. Cl. ..... 473/345; 473/338

[58] Field of Search ..... 273/167 H, 174, 273/167 A, 167 F, 169–171, 172, 167 R, 167 E; 473/345, 338

[56] References Cited

U.S. PATENT DOCUMENTS

| | | | |
|---|---|---|---|
| 1,167,106 | 1/1916 | Palmer . | |
| 1,235,922 | 8/1917 | Pittar . | |
| 1,269,745 | 6/1918 | Robertson . | |
| 1,526,438 | 2/1925 | Scott . | |
| 1,568,888 | 1/1926 | Dunn . | |
| 1,582,836 | 4/1926 | Link . | |
| 1,601,770 | 10/1926 | Reach et al. . | |
| 1,616,920 | 2/1927 | Pedersen . | |
| 1,968,092 | 7/1934 | Oldham . | |
| 2,067,556 | 1/1937 | Wettlaufer . | |
| 2,171,383 | 8/1939 | Wettlaufer . | |
| 2,447,967 | 8/1948 | Stone . | |
| 3,191,936 | 6/1965 | Guier . | |
| 3,212,783 | 10/1965 | Bradley et al. . | |
| 3,819,181 | 6/1974 | Mills . | |
| 3,941,390 | 3/1976 | Hussey . | |
| 3,967,826 | 7/1976 | Judice . | |
| 3,976,299 | 8/1976 | Lawrence et al. . | |
| 3,995,865 | 12/1976 | Cochran et al. . | |
| 4,021,047 | 5/1977 | Mader . | |
| 4,063,737 | 12/1977 | Tom et al. . | |
| 4,214,754 | 7/1980 | Zebelean . | |
| 4,417,731 | 11/1983 | Yamada | 273/167 H |
| 4,429,879 | 2/1984 | Schmidt . | |
| 4,438,931 | 5/1984 | Motomiya . | |
| 5,090,702 | 2/1992 | Viste . | |
| 5,154,424 | 10/1992 | Lo | 273/169 |
| 5,232,224 | 8/1993 | Zeider . | |
| 5,251,901 | 10/1993 | Solheim | 273/167 A |
| 5,261,664 | 11/1993 | Anderson | 273/167 H |
| 5,273,283 | 12/1993 | Bowland | 273/167 H |

FOREIGN PATENT DOCUMENTS

| | | |
|---|---|---|
| 211781 | 12/1957 | Australia . |
| 371974 | 5/1932 | United Kingdom . |
| 398643 | 9/1933 | United Kingdom . |
| 679292 | 9/1952 | United Kingdom . |
| 1476889 | 6/1977 | United Kingdom . |

*Primary Examiner*—Sebastiano Passaniti
*Attorney, Agent, or Firm*—Craig P. Opperman, Esq.

[57] ABSTRACT

A metal wood golf club head includes a hollow body with a front wall and a lower face, and a separate sole plate for securing across the lower face to form a lower wall of the head. The body has an internal cavity and an opening in the lower face leading into the cavity over which the sole plate extends. The sole plate is secured across the lower face by a suitable securing device. The front wall has an extended portion extending downwardly beyond the lower face against which the sole plate abuts when secured across the lower face.

16 Claims, 2 Drawing Sheets

GOLF CLUB HEAD WITH INTERLOCKING SOLE PLATE

BACKGROUND OF THE INVENTION

The present invention relates generally to golf clubs, and is particularly concerned with golf club heads of the so-called "metal wood" type.

Golf clubs are generally divided into four main types, comprising putters, irons, fairway clubs and drivers. Drivers in the past were normally made of wood, and so were often referred to as "woods". More recently, drivers have been made of metal for increased durability and better playing characteristics. Such drivers are commonly referred to as metal woods.

Metal woods are normally made of stainless steel, which is relatively heavy, and are conventionally manufactured by investment casting a hollow, stainless steel shell as a single hollow unit. Some metal woods are made in two or more pieces which are then welded or otherwise secured together. In some clubs, the sole plate is formed separately from the remainder of the head as a flat plate which is subsequently welded or otherwise attached to the remainder of the head. In U.S. Pat. No. 4,429,879 of Schmidt, for example, a hollow metal wood head is formed with an opening in the bottom wall of the head. Multiple ledges are formed around the opening, and the flat sole plate is seated on the ledges and welded in position.

There are some disadvantages in making metal woods by investment casting. The investment casting process can be inconsistent, producing a golf club with an inconsistent face possibly containing sinks. Thus, such heads must normally be polished and cosmetically sand blasted to hide imperfections. Because of the weight of stainless steel, and the restrictions on acceptable club head weight, hollow stainless steel club heads must normally have relatively thin walls to meet weight standard requirements. When investment casting thin wall stainless steel heads, a large number of rejections result due to porosity and thin spots. Additionally, the thin walls result in relatively high amounts of club face deflection when the club head strikes the ball, resulting in inconsistent performance.

SUMMARY OF THE INVENTION

It is an object of the present invention to provide a new and improved metal wood golf club head.

According to the present invention, a metal wood golf club head is provided which comprises a hollow body having a front wall with an outer striking face, a rear wall, an upper wall or crown, a lower face, a heel and a toe, the body having an internal cavity and the lower face having an opening leading into the cavity, and a separate sole plate secured across the lower face to form at least part of the lower wall of the club head terminating short of the front, striking face. The lower face may form an inner wall of a machined recess having an inwardly extending bearing face extending inwardly towards the upper wall at a location spaced from the outer face. The sole plate has a front face shaped and dimensioned to match the recess bearing face, and the front face is an interference fit against the recess bearing face when the sole plate is secured in the recess.

In a preferred embodiment of the invention, the sole plate and recess have interengageable, mating formations for releasable mating engagement when the sole plate is placed in the recess, so that the sole plate is initially held in the recess, and the parts can subsequently be secured together by any suitable securing device such as welding, adhesive or screw fasteners or the like. This avoids the need for separate holding devices for holding the sole plate in the recess as the parts are secured together. Additionally, the mating formations are designed such that the front face of the sole plate is forced against the recess bearing face as the parts are secured together, ensuring a close interference fit with essentially no gaps between the parts. The abutment of the sole plate up against the rear of the front face also acts to strengthen the club face and resist deformation.

In one embodiment of the invention, the mating formations comprise one or more lugs projecting from the sole plate for engagement in the recess opening, the opening having a peripheral rim for engaging the or each lug as it is inserted in the opening. Preferably, each lug is located at the rear of the sole plate so as to extend into the opening adjacent the rear wall of the club. In this way, as the lugs are forced into the opening, the sole plate in turn is biased forwardly against the bearing face of the recess. The lugs have outer faces for engagement with the peripheral rim of the opening, and the outer faces are preferably tapered so that the sole plate is forced against the bearing face more and more as the sole plate is secured in the recess, producing a close interference fit.

The sole plate has an outer periphery shaped to match that of the club head surfaces adjacent the recess, so that it forms a smooth continuation of the rear wall, heel, toe, and lower wall of the club. Preferably, the sole plate has a plurality of fastener openings for receiving suitable fasteners for securing the sole plate in the recess, and the rearwardly extending face of the recess has corresponding threaded openings aligned with the openings in the sole plate when it is placed in the recess. The openings in the sole plate are preferably indented inwardly from the outer surface of the sole plate so that the screw heads do not protrude outwardly from the sole plate.

The close fitting of the sole plate in the club body recess ensures that the bottom of the club is completely or substantially smooth. The abutment of the sole plate against the bearing face behind the striking face, together with the interlocking connection between the sole plate and recess, is such that as the screws screw the sole plate into position, the sole plate is forced to press with substantial force against the rear bearing face of the front face of the club head. This forms an interlocking fit which adds strength to the striking face and helps to reduce face movement on impact with a ball. It also provides a smooth transition from the sole plate to the body of the club.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
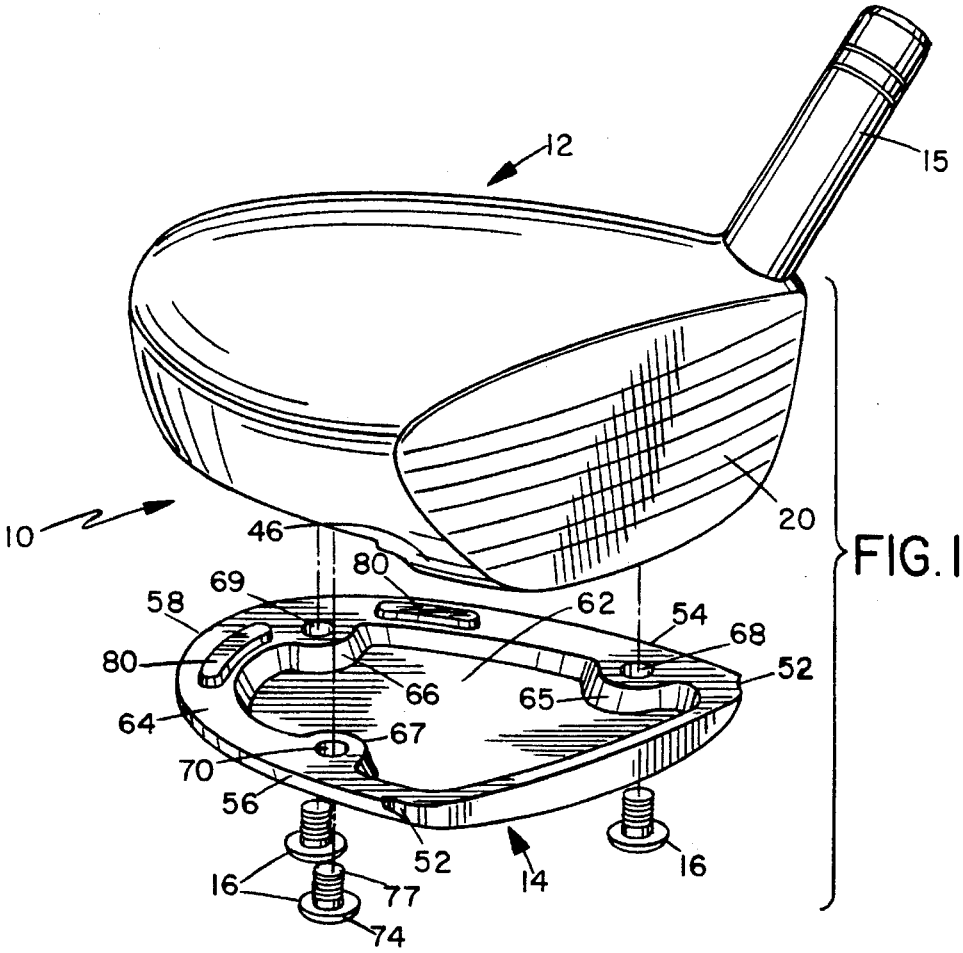
FIG. 1 is a perspective view of the golf club head according to a preferred embodiment of the invention with the sole plate separated from the body of the head.

The drawings illustrate a golf club head 10 of the metal wood type according to a preferred embodiment of the present invention. The head 10 basically comprises a body 12 and separate sole plate 14 which is secured to the body by fastener screws 16. A hosel tube or tube neck 15 is secured in a bore in the body 12 at a suitable orientation for receiving a golf club shaft, preferably as described in our co-pending application entitled "Golf Club Head" filed on even date herewith, the contents of which are incorporated herein by reference. The hollow body 12 may be made by any suitable method but is preferably made by milling out a solid billet, as described in our co-pending application Ser. No. 08/159,738 filed Nov. 30, 1993, the contents of which are incorporated herein by reference. The body and sole plate may be of any suitable metal, but are preferably of aluminum alloy material, as described in application Ser. No. 08/159,738.

Body 12 has a front wall 18 with an outer, striking face 20, an upper wall or crown 22, a rear wall 24, a lower wall 26, a heel 27 and a toe 28, and an internal cavity 30 of dimensions determined by the desired wall thicknesses, as described in our co-pending application entitled "Golf Club Head with Peripheral Weighting," filed on even date herewith. The lower wall 26 has a recess 32 having a first, inwardly extending bearing face 34 extending inwardly from the lower wall towards the upper wall at a location behind the front or striking face 20, and a rearwardly extending inner face 36 extending substantially perpendicular to the bearing face 34 towards the rear of the head, that is, extending rearwardly from the bearing face towards the rear wall of the club, and outwardly to the outer periphery of the head around the toe, rear wall and heel of the head.

Figure 2:
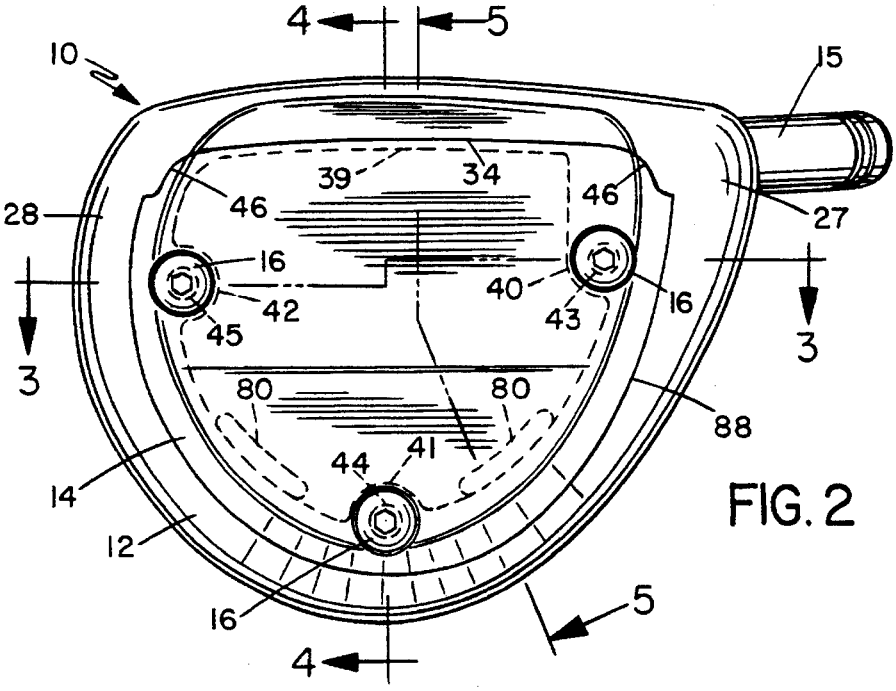
FIG. 2 is a bottom plan view of the club head.
Figure 3:
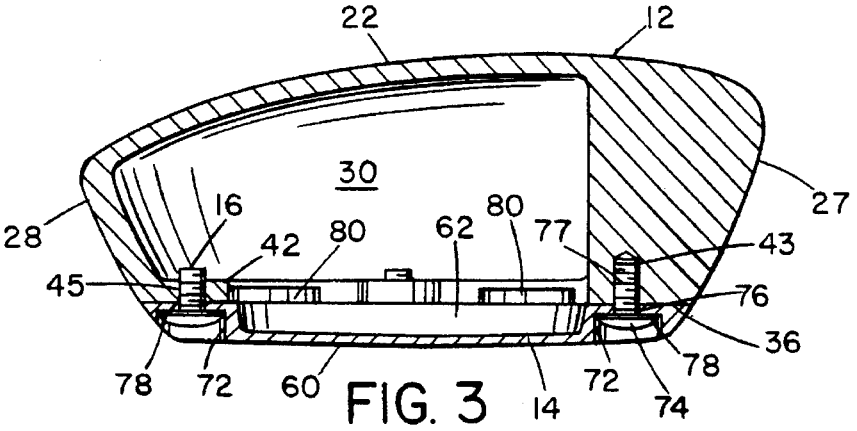
FIG. 3 is a sectional view taken on line 3—3 of FIG. 2.

The inner face 36 of the recess has an opening 38 having a peripheral rim 39. The shape of the peripheral rim of opening 38 is best illustrated in dotted outline in FIG. 2. As illustrated in FIG. 2, rim 39 has inwardly projecting lobes 40,41,42 arranged at spaced intervals around its periphery. One of the lobes 41 is located adjacent the rear wall 24, while the other two 40,42 are located at the heel and toe, respectively. Each lobe has a threaded hole or opening 43,44,45, respectively for receiving the shaft of a respective fastener screw. Because of the increased wall thickness at the heel 27, as best illustrated in FIG. 3, the lobe 40 lies over, and forms part of, the heel 27 rather than over the cavity 30, as is the case with lobes 41 and 42. Thus, threaded hole or bore 43 extends into the heel 27 as illustrated in FIG. 3. However, the wall thickness at the heel may be varied for different golf club playing requirements, and lobe 40 may overlie the cavity in the same way as lobes 41 and 42 in some cases.

As best illustrated in FIGS. 1, 2, 5 and 6, the bearing face 34 extends substantially parallel to the front face 20 of the club and perpendicular to the lower wall 26 across the majority of its width, but has a rearwardly curved ear portion 46 at each end. Each ear portion curves first rearwardly and then downwardly at its outer peripheral edge to meet the outer periphery of the inner wall 36 at the heel and toe, forming a distinctive curlicue as best illustrated in FIG. 2. The inner face 36 of the recess is flat, and the opening 38 in face 36 is cut so that the face 36 forms a flat ledge or rim which extends around the entire periphery of opening 38, including a small ledge portion 48 along bearing face 34. This ledge forms a locating seat for the sole plate 14, as will be described in more detail below.

The sole plate 14 may be of the same material as the club head body 12 or a similar aluminum alloy, and may be formed in any suitable manner, for example by a computer controlled milling process as described in our pending application No. 08/159,738 referred to above. The sole plate 14 has an outer periphery shaped to match the outer periphery of recess 32 and is a close interference fit in the recess. The sole plate has a flat front face 50 for fitting against recess bearing face 34, curved portions 52 at opposite ends of face 50 for fitting against the corresponding curved ear portions 46 of the recess, heel and toe portions 54,56, rear portion 58, and lower face 60. The peripheral heel, toe and rear portions are tapered inwardly to meet the substantially flat lower face 60 of the sole plate, as best illustrated in FIGS. 2, 3, 4 and 5.

Figure 4:
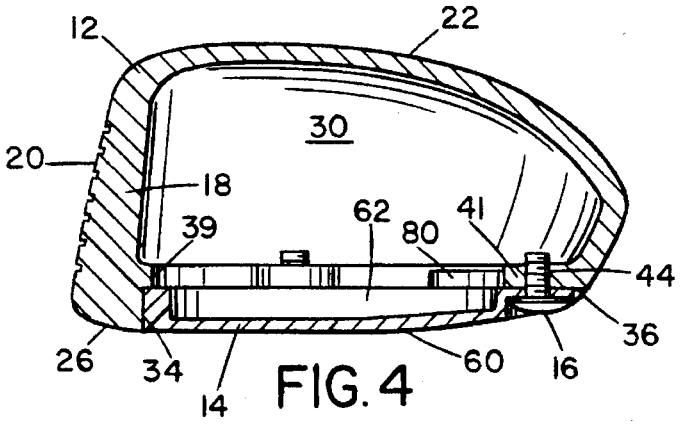
FIG. 4 is a sectional view taken on line 4—4 of FIG. 2.

The inner face of the sole plate has a machined, recessed area 62 for providing the desired wall thickness at the sole of the club head, and a flat peripheral rim 64 of shape substantially matching that of the inner face 36 of the recess surrounding opening 38. Thus, rim 64 has inwardly projecting lobes 65,66,67 at locations matching those of lobes 40,41 and 42 of the recess in the lower wall of the body. Lobe 66 is at the rear portion 58 of the sole plate while lobes 65 and 67 are at the heel and toe, respectively. A through bore 68,69,70 respectively extends through the sole plate at the center of each lobe 65,66,67. Bores 68,69,70 are aligned with the respective threaded holes 43,44,45 in the head when the sole plate is engaged in the recess. As best illustrated in FIGS. 3 and 4, each of the bores 68,69 and 70 is of stepped diameter, including a larger diameter portion 72 extending inwardly from the lower face 60 of the sole plate for receiving the head 74 of a respective fastener screw, and a smaller diameter portion 76 through which the shaft 77 of the screw extends with the head 74 seated on shoulder 78 between the two bore portions. Thus, the screw heads are recessed inwardly from the outer surface of the sole plate and do not protrude outwardly where they would interfere with play and be liable to be damaged with use. The screws may be of different lengths to allow weight adjustment, as described in our co-pending application entitled "Golf Club Head with Adjustable Weighting," filed on even date herewith, the contents of which are incorporated herein by reference.

Figure 5:
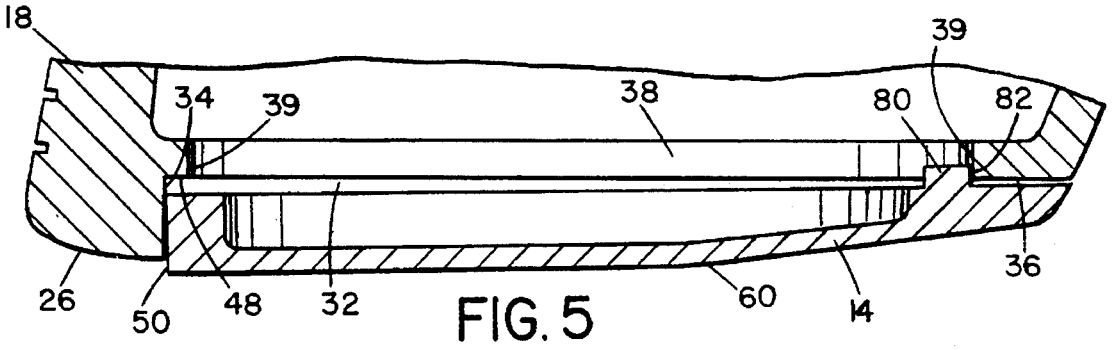
FIG. 5 is an enlarged sectional view taken on line 5—5 of FIG. 2, showing the seating action of the sole plate.
Figure 6:
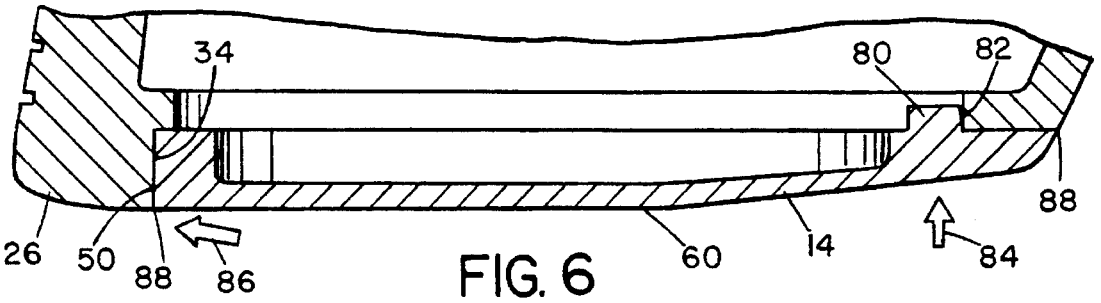
FIG. 6 is a view similar to FIG. 5, with the sole plate fully seated.

A pair of lugs 80 project from flat rim 64 of the sole plate for engagement inside the rim 39 of opening 38, and are shaped at their outer wall 82 to exactly match the curvature of the rim 39 at that location. The lugs 80 are located on opposite sides of the lobe 66 at the rear of the sole plate, and the lugs and rim 39 together form interengageable mating formations for holding the sole plate in the recess when the lugs are forced into the opening 38 as illustrated in FIGS. 5 and 6. As best illustrated in FIGS. 5 and 6, the outer or rear wall 82 of each lug is tapered inwardly towards its outer end, and the spacing between rear wall 82 and front face 50 of the sole plate is arranged to provide an interference fit between the two parts when the sole plate is pushed into position as illustrated in FIG. 6. In other words, as the sole plate is pushed into the recess with the lugs 60 engaging inside the peripheral rim 39 of the opening, in the direction of arrow 84 in FIG. 6, the engagement of the tapered walls 82 of the lugs with the rim 39 will act to progressively push front face 50 up against bearing face 34 of the recess, in the direction of arrow 86. This results in the face 50 abutting closely against bearing face 34 so that there is essentially no gap between the faces.

In practice, once the sole plate is engaged in the recess as illustrated in FIG. 6, it will be held relatively firmly in place by the interference fit between the parts even without the fastener screws 16. Screws 16 are then inserted through the respective aligned bores 68 and 43, 69 and 44, 70 and 45, and tightened to secure the parts together. Because of the extremely tight, interference fit between the sole plate and recess, the surface of the club will be substantially smooth even across the joint line 88 between the parts, since there will be substantially no gap whatsoever at joint 88. The lugs 60 act to force the front face 50 into close abutment with bearing face 34, while the curved portions 52 of the sole plate are held between ear portions 46 to prevent any free play in a side to side direction.

In practice, the outer surface of sole plate 14 may be machined at the same time as the outer surfaces of the club head, after the sole plate is first secured in the recess. This will ensure a smooth transition from the heel, toe and rear of the head to the heel, toe and rear of the sole plate, and a perfect match between these parts, as described in co-pending application Ser. No. 08/159,738 referred to above. Although the sole plate is attached by fastener screws 16 in the illustrated embodiment, it will be understood that it may alternatively be secured to the body by bonding, welding or equivalent techniques. The recess 32 and the peripheral rim 39 of the opening 38, and the flat rim 64, lugs 80, front wall 50 and curved portions 52 of the sole plate, are each machined precisely so that they are an exact match to produce the desired interference fit between these parts, as illustrated in FIGS. 3–6.

The abutment of the front face 50 of the sole plate up against the bearing face or inner face 34 of the front wall of the body acts to reinforce the striking face 20. This improves the striking sound of the club, and reduces or avoids working of the sole plate relative to the face of the club. It will also act to reduce deformation of the striking face 20. The close abutment or interference fit of the front face 50 with bearing face 34, leaving essentially no gap at junction or joint line 88, also avoids ingress of grass and dirt between the sole plate and body.

Although a preferred embodiment of the invention has been described above by way of example only, it will be understood by those skilled in the field that modifications may be made to the disclosed embodiment without departing from the scope of the invention, which is defined by the appended claims.

We claim:

1. A metal wood golf club head, comprising:

a body having a front wall with an outer striking face, a rear wall, an upper wall, a lower face, and side walls extending from said rear wall to said front wall;

the body having an internal cavity and an opening in said lower face leading into said cavity;

a separate sole plate secured over said lower face to cover said opening, said sole plate forming a lower wall of said club head terminating short of the striking face, the lower wall being formed substantially entirely by said sole plate;

interchangeable, mating formations in the sole plate and the body, such formations for releasable mating engagement of the sole plate and the body; and releasable securing means for securing said sole plate across said lower wall.

2. The head as claimed in claim 1, wherein said front wall has an extended portion extending downwardly from said lower face of said body, said extended portion having an inner, bearing face; and the sole plate has a front wall matching said bearing face for abutment with said bearing face and an inner wall matching said lower face of said body for abutment with said lower face when said sole plate is secured to said body.

3. The club head as claimed in claim 1, wherein said opening has a peripheral rim and the sole plate has at least one lug for projecting into said opening when said sole plate is secured across said lower face, said lug having an outer wall shaped and positioned for abutment with said peripheral rim as said sole plate is secured across said lower face, said lug and peripheral rim comprising said interengageable mating formations.

4. The club head as claimed in claim 3, wherein said sole plate has two lugs positioned adjacent the rear wall of said body when said sole plate is secured across said lower face.

5. The club head as claimed in claim 3, wherein said lug has an outer end and said outer wall is tapered inwardly towards said outer end.

6. The club head as claimed in claim 2, wherein said sole plate has a plurality of through bores and said lower face of said body has a plurality of threaded holes, each hole being in alignment with a respective one of said bores when said sole plate is placed over said lower face, and said securing means comprises a plurality of fastener screws for projecting through said bores in said sole plate and engaging in said threaded holes in said lower face to secure said sole plate to said body.

7. The club head as claimed in claim 6, wherein said sole plate has a lower surface for forming a sole of said club head, each screw has a head and a threaded shaft, and said through bores are recessed to receive said screw heads so that they are positioned inwardly of said sole plate lower surface.

8. The club head as claimed in claim 2, wherein said bearing face extends substantially parallel to said striking face and has rearwardly curved portions at opposite ends of said face, and said sole plate front face has correspondingly curved portions for fitting against said rearwardly curved portions of said bearing face.

9. The club head as claimed in claim 2, wherein the lower face of said body is a flat face extending substantially perpendicular to said bearing face, and said inner wall of said sole plate comprises a flat face matching the lower face of said body.

10. The club head as claimed in claim 9, wherein the inner face of said sole plate has a recessed area, said flat face comprising a flat rim surrounding said recessed area.

11. The club head as claimed in claim 10, wherein the lower face of said body comprises a flat rim surrounding said opening, said flat rim of said recess being of shape and dimensions substantially matching the shape and dimensions of the flat rim of said sole plate.

12. The club head as claimed in claim 11, including at least one lug projecting from the flat rim of said sole plate for engagement in said opening.

13. The club head as claimed in claim 1, wherein said sole plate has a lower surface forming the sole of said club head and peripheral rear wall and side walls shaped to match the contour of the corresponding side walls and rear wall of said body, whereby said peripheral walls of said sole plate form a smooth continuation of the peripheral and rear walls of said body down to said lower surface of said sole plate.

14. The head as claimed in claim 2, wherein the front wall of said sole plate is machined to match the shape and dimensions of said bearing face of said body, and said securing means comprises means for urging said front wall into close abutment with said bearing face whereby there is substantially no gap between said front wall and bearing face.

15. A golf club head, comprising:

a body having a front striking face, a rear wall, an upper wall, a lower wall, a heel and a toe;

the body having an internal cavity and a recess in said lower wall having an opening leading into said cavity;

a separate sole plate having inner surfaces machined to exactly match the shape and dimensions of said recess, whereby said sole plate in an interference fit in said recess;

interchangeable, mating formations in the sole plate and the body, such formations for releasable mating engagement of the sole plate and the body; and securing means for securing said sole plate in said recess.

16. The head as claimed in claim 15, wherein said recess has a first, inwardly extending bearing face extending inwardly from said lower wall towards said upper wall at a location spaced rearwardly from said striking face and a second, rearwardly extending face extending rearwardly from said bearing face towards the rear wall of said club, the second face having said opening; and the sole plate has a front wall matching said bearing face for abutment with said bearing face and an inner face matching said second face of said recess for abutment with said second face when said sole plate is secured in said recess.

* * * * *